US005274850A

United States Patent [19]

Aldridge

[11] Patent Number: 5,274,850

[45] Date of Patent: Jan. 4, 1994

[54] FIREFIGHTER COAT WITH REMOVABLE HOOD

[75] Inventor: Donald Aldridge, New Carlisle, Ohio

[73] Assignee: Lion Apparel, Inc., Dayton, Ohio

[21] Appl. No.: 872,625

[22] Filed: Apr. 22, 1992

[51] Int. Cl.[5] ..... A41D 13/00

[52] U.S. Cl. ..... 2/84; 2/81; 2/98; 2/202

[58] Field of Search ..... 2/7, 8, 81, 82, 84, 2/85, 86, 87, 93, 97, 98, 108, 129, 135, 171, 172, 202, 205

[56] References Cited

U.S. PATENT DOCUMENTS

| | | | |
|---|---|---|---|
| 355,213 | 12/1886 | Robinson | 2/87 |
| 1,219,335 | 3/1917 | McCall | 2/98 |
| 1,570,917 | 1/1926 | Orent | 2/85 |
| 2,002,955 | 2/1935 | Lipson | 2/84 |
| 2,686,317 | 8/1954 | Michaelis | 2/205 |
| 2,834,966 | 5/1958 | Zimmerman | 2/84 |
| 3,147,490 | 10/1962 | Allen et al. | 2/84 |
| 4,034,417 | 7/1977 | Ellis | 2/81 |
| 4,042,976 | 8/1977 | Reynolds | 2/135 |
| 4,507,806 | 4/1985 | Coombs | 2/85 |
| 4,604,759 | 8/1986 | Bowman et al. | 2/81 |
| 4,774,725 | 10/1988 | Page | 2/81 |
| 4,975,980 | 12/1990 | Ersteniuk | 2/6 |
| 5,005,216 | 4/1991 | Blackburn | 2/84 |
| 5,090,054 | 2/1992 | Grilliot et al. | 2/5 |
| 5,109,549 | 5/1992 | Mattinson | 2/202 |
| 5,115,517 | 5/1992 | Ferguson | 2/84 |
| 5,127,106 | 7/1992 | Aldridge | 2/81 |

FOREIGN PATENT DOCUMENTS

| | | | |
|---|---|---|---|
| 1291012 | 3/1962 | France | 2/84 |

*Primary Examiner*—Clifford D. Crowder
*Assistant Examiner*—Diana L. Biefeld
*Attorney, Agent, or Firm*—Thompson, Hine and Flory

[57] ABSTRACT

A firefighter coat having an outer shell which includes body and collar portions, an inner thermal liner having body and collar portions, and a hood including a rear portion having strips of hook and loop fastener material, located on opposing surfaces, for engaging complementary strips of hook and loop fastener material located on adjacent surfaces of the outer and inner collar portions. The hood includes a front bib for protecting the neck of the wearer and which includes tabs of fastener material for attachment to the outer collar portion. The hood may be carried on the back of the coat when not worn, or removed from the coat entirely, wherein the strips of fastener material on the inner and outer collar portions join the collar portions together to make a complete collar for the coat.

3 Claims, 2 Drawing Sheets

FIREFIGHTER COAT WITH REMOVABLE HOOD

BACKGROUND OF THE INVENTION

This invention generally relates to firefighting apparel and, more particularly, to a firefighter coats with protective hoods.

In addition to wearing a specially-designed coat and pant, firefighters often wear a hood for protection in firefighting situations. Typically, the coat is worn to protect the torso and arms while the hood is worn to protect the head and neck and includes an opening for the face of the firefighter. The coat includes a collar, made of the same material as the coat, which also contributes to the protection of the neck of the firefighter. Consequently, the hood eliminates any gap in protection provided by the protective gear for the neck, cheek and ears of the wearer in the area between the helmet and the coat collar of the firefighter.

The hood typically is constructed of a knit, flame resistant material having thermal resistance properties, such as an aramid fiber, which serves to insulate the head of the firefighter as well as protect against burns in the region covered by the hood. Because the hood is made of a thermal barrier material, it typically is manufactured as a separate article giving a firefighter the option to wear or not wear the hood in a particular firefighting situation. For example, a firefighter may decide to forego wearing a hood when the outside temperature is extremely high and the firefighter is acting in a situation in which the likelihood that the firefighter could receive burns to the head or neck area is remote.

However, a problem exists with respect to conventional firefighter hoods. Since such hoods are separate articles, they may be misplaced or forgotten by firefighters in the excitement of responding to an emergency, in which case they would be unavailable when needed. Attempts to solve this problem have been made. For example, Ersteniuk U.S. Pat. No. 4,975,980 discloses a hood which is attachable to the inside of a firefighter helmet. Although attaching the hood to the inside of the helmet may solve the problem of misplacing the hood, it has made the hood more difficult to secure.

An additional problem exists with prior hood designs, regardless of whether the hood is separate or attached to the helmet. Since there is no mechanical attachment between the hood and coat, embers and debris can pass between the hood and the inside of the coat, thereby causing discomfort to the firefighter and increasing the frequency of required laundering. Such repeated cleaning increases the rate of wear of the coat which shortens its useful life and increases maintenance costs. Therefore, a need exists for an improved firefighter coat and hood design that eliminates the problems associated with previous hood designs, and provides the required protection for the firefighter.

SUMMARY OF THE INVENTION

The present invention is a firefighter coat with a removable hood which protects the wearer's head and neck and eliminates the problems associated with prior art designs. The coat includes an outer shell and a separable, inner thermal liner and moisture barrier, the shell and liner each having co-extensive collar portions, and a hood having a rear flap shaped to be sealed between the collar portions. The front portion of the hood is releasably attachable to the front portion of the outer shell collar portion when the hood is not being worn.

Accordingly, the hood is readily accessible to the wearer when needed and is carried unobtrusively when not in use. Since the hood is not attached to a helmet, it is easy to put on. Additionally, the hood connection in between the shell and liner collar portions provides a sealing barrier to prevent embers and dirt from entering the inside of the coat.

In a preferred embodiment, the inner faces of the shell and liner collar portions and the rear flap include strips of hook and loop material which effects a continuous seal and yet allows rapid attachment and removal of the hood from the coat. When the hood is removed, the hook and loop fastener strips of the shell and liner collar portions can be fastened to each other to form a complete collar. Other fastening mechanisms may be employed to attach the hood to the collar portions, such as a slide fastener or snaps, and not depart from the scope of the invention.

Accordingly, it is an object of the present invention to provide a firefighter coat and hood combination in which the hood is easily attachable to and removable from the coat for replacement and cleaning; a coat and hood combination which provides easy and immediate accessibility to the hood when not in use; a coat and hood combination that prevents embers and dirt from entering the back inside of the coat; and a coat and hood combination which is of relatively simple and inexpensive construction.

These and other features and advantages of the invention will be better understood by reference to the following detailed description, the accompanying drawing and the appended claims.

DETAILED DESCRIPTION

Figure 1:
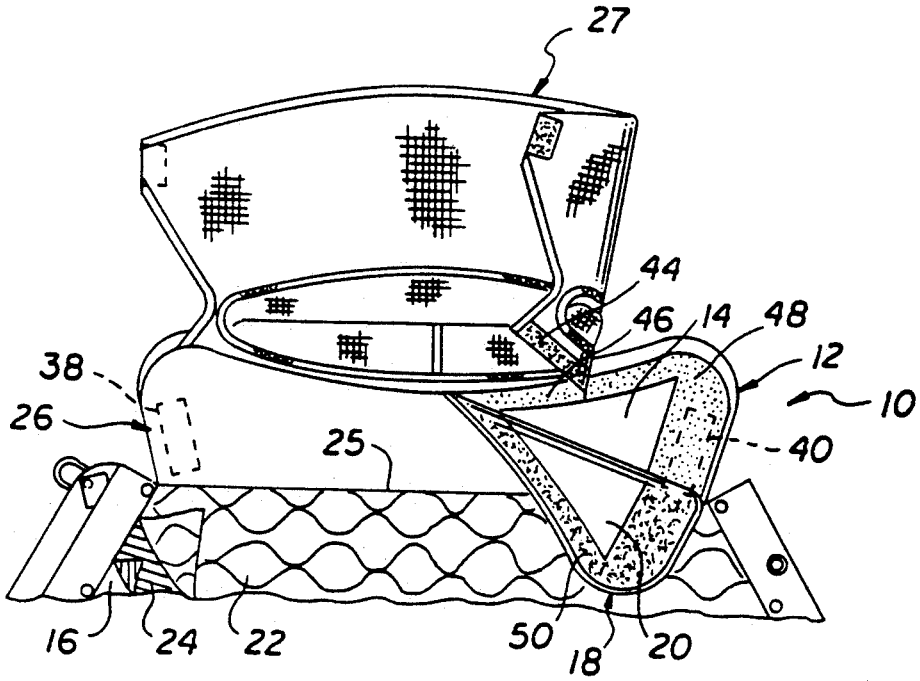
FIG. 1 is a partial front elevational view of the coat and hood combination of the present invention showing the collar portions of the shell and liner partially separated and the hood partially attached to the collar.

As shown in FIG. 1, a firefighter coat, generally designated 10, of the present invention includes an outer, fire-resistant shell 12 having an integral, outer collar portion 14 and a body portion 16. The coat 10 includes an inner thermal liner 18 having an integral, inner collar portion 20 and a body portion 22, the latter including a moisture barrier 24 on an outer surface The collar portions 14,20 are co-extensive about the entire neck opening 25 of the coat 10 and are made of shell material The collar portions 14, 20 together comprise the collar 26 of the coat 10.

The shell 12 and collar portions 14, 20 preferably constructed of a woven aramid material, such as NOMEX or KEVLAR (NOMEX and KEVLAR are registered trademarks of E. I. DuPont de Nemours & Co., Inc.). The moisture barrier 24 preferably is constructed of a NOMEX/KEVLAR combination laminated with a teflon film such as GORE-TEX (GORE-TEX is a registered trademark of W. L. Gore & Associates, Inc.). The thermal liner 22 preferably is a NOMEX face cloth quilted to two layers of a NOMEX/KEVLAR blend.

Figure 2:
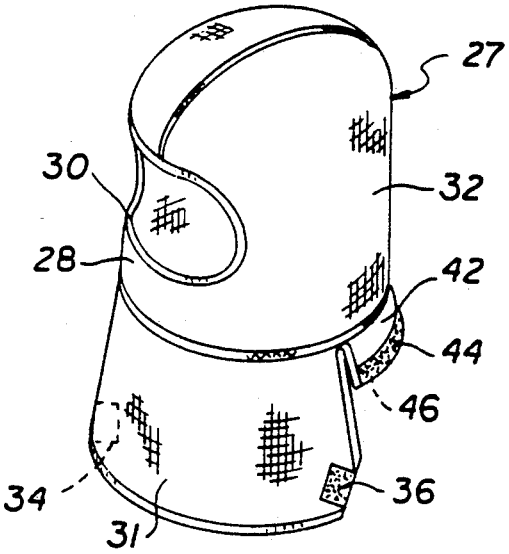
FIG. 2 is a perspective view of the hood of FIG. 1.

As shown in FIGS. 1 and 2, the coat 10 includes a removable hood 27 having a front portion 28, a face opening 30 and a rear portion 32. A bib 31 extends along and downwardly from the bottom of the front portion 28 and includes tabs 34, 36, each consisting of one component of a hook and loop fastener Tabs 34, 36 are positioned on the sides of the bib 31 to engage complementary tabs 38, 40 of hook and loop fastener material attached to the outer surface of the outer collar portion 14 (see FIG. 1). Fastener tabs 34, 36 are provided so that the hood 27, when not in use, can be stowed along the outer collar portion 14 and made easily accessible when use is desired. Bib 31 protects the throat area of the firefighter and is tucked inside the coat 10 when the hood 27 is being worn (see FIG. 6).

A flap 42 extends downwardly from the periphery of the lower edge of the rear portion of the hood 27 and includes strips 44, 46 of one component of hook and loop material (see also FIG. 1), located along opposing surfaces of the lower edge of the flap. Strips 44, 46 cooperate with complementary strips 48, 50 of hook and loop material which extend along the outer perimeters of adjacent surfaces of the outer collar portion 14 and inner collar portion 20, respectively. Consequently, the hood flap 42 is attached to the coat 10 between the collar portions 14, 20 along the entire length of the flap, which extends along the entire neck opening 25. Further, the hood 27 can be totally removed from the coat 10 when not desired, and the strips 48, 50 of the collar portions 14, 20 joined to each other to make a complete collar.

Since the flap 42 of the rear portion 32 of the hood 27 is secured between the outer and inner collar portions 14, 20, respectively, a seal is formed around the back of the wearer's head, thus preventing embers and dirt from entering the inside of the coat 10. The hood 27 preferably is made of a knit, flame-resistant, thermal-resistant material such as NOMEX or KEVLAR.

Figure 3:
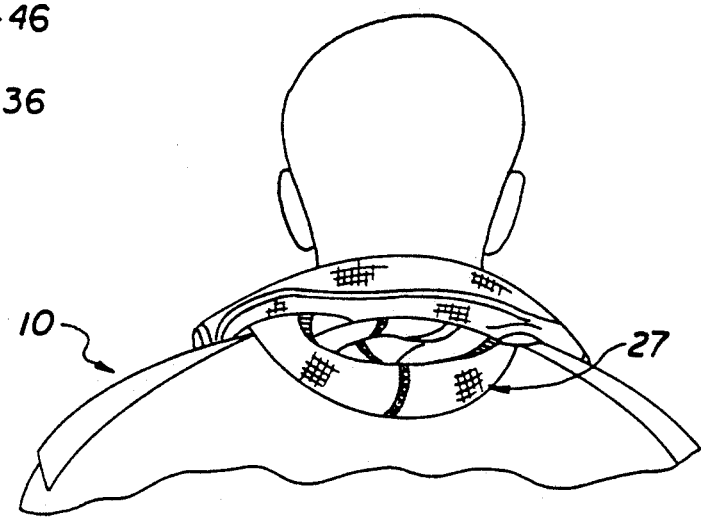
FIG. 3 is a partial rear elevational view of the combination of FIG. 1 in the stowed position.
Figure 4:
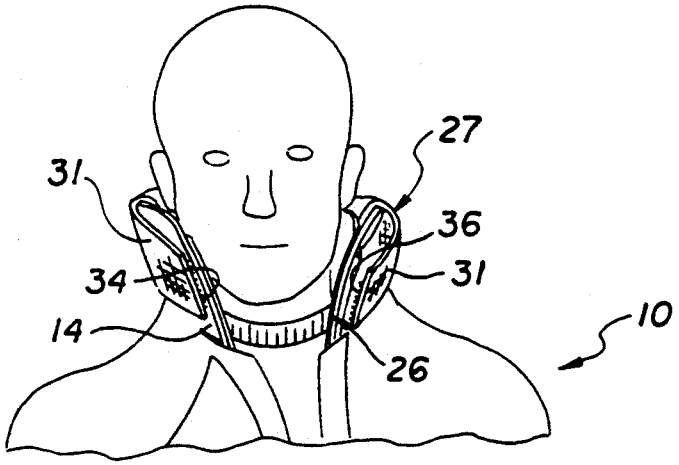
FIG. 4 is a partial front elevational view of the combination of FIG. 1 in the stowed position.

As shown in FIGS. 3 and 4, the hood 27 may be carried when not in use on the upper back of the coat 10 with the tabs 34, 36 on the front portion of the hood fastened to the corresponding tabs 38, 40 (see FIG. 1) on outer collar portion 14. The attachment between the bib 31 and the collar portion 14 also helps to keep the collar 26 out of the face of the firefighter when the hood 27 is carried but not worn.

Figure 5:
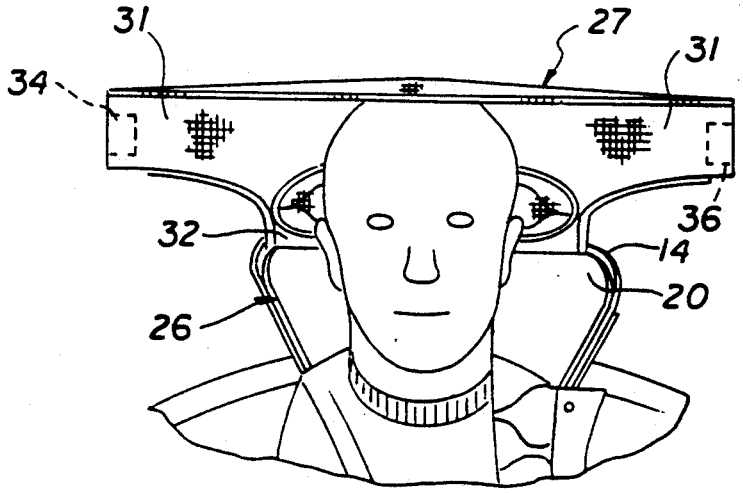
FIG. 5 is a partial front elevational view of the combination of FIG. 1, in which the hood is shown in a partially deployed position.
Figure 6:
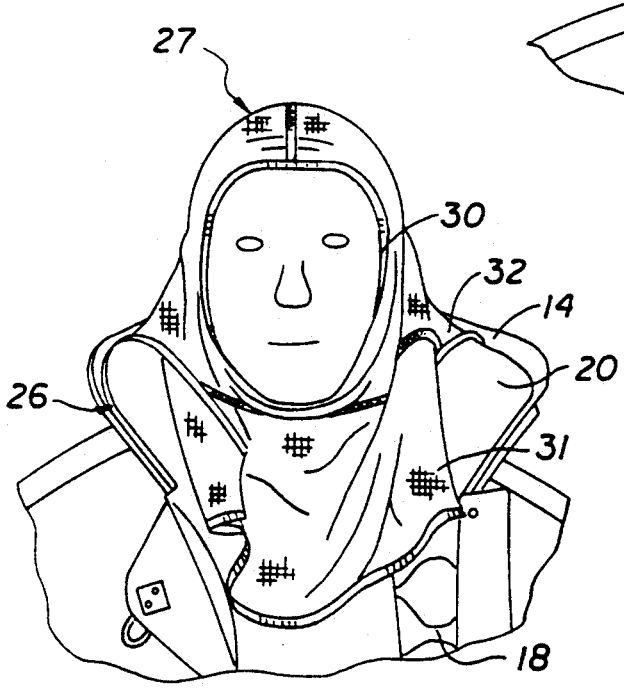
FIG. 6 is a partial front elevational view of the present invention in a totally deployed position.

Referring now to FIGS. 5 and 6, when the hood 27 is to be used, a firefighter wearing the coat 10 grasps bib 31, disengaging tabs 34, 36 from the outer collar portion 14. The firefighter can then pull the hood 27 forward over his head, placing the opening 30 about his face and tucking the bib 31 inside the inner thermal liner 18.

The proceeding description has been presented with reference to a presently preferred embodiment to the invention shown in the drawings. Workers skilled in the art and technology to which this invention pertains will appreciate that alterations and changes in the described structure can be practiced without departing from the spirit, principles and scope of this invention.

What is claimed is:

1. In combination, a firefighter coat and a removable hood therefore, comprising:

an outer fire resistant shell having a body portion and a collar portion;

an inner thermal liner located inside said outer shell having a body portion and a collar portion;

said outer and inner collar portions including complementary fastening means located on adjacent surfaces thereof; and a moisture barrier located between said outer shell and inner liner;

said hood including a rear portion having a flap extending from a lower edge thereof and having fastening means located on opposing surfaces thereof for releasable attachment to said adjacent surfaces of said collar portions; and a front portion defining a face opening and having means for releasably attaching the front portion to said outer collar portion when said hood is not worn.

2. The combination of claim 1 wherein said fastening means is a hook and loop fastener.

3. The combination of claim 1 wherein said hood is made of an aramid fiber.

* * * * *